US006725799B2

(12) United States Patent
Tull

(10) Patent No.: US 6,725,799 B2
(45) Date of Patent: Apr. 27, 2004

(54) CUSTOMIZABLE BOAT T-TOP AND METHOD OF INSTALLATION

(76) Inventor: R. Stevens Tull, P.O. Box 829, Barnegat, NJ (US) 08005

( * ) Notice: Subject to any disclaimer, the term of this patent is extended or adjusted under 35 U.S.C. 154(b) by 2 days.

(21) Appl. No.: 10/022,560

(22) Filed: Dec. 14, 2001

(65) Prior Publication Data

US 2003/0111101 A1 Jun. 19, 2003

(51) Int. Cl.[7] ..... B63B 17/00
(52) U.S. Cl. ..... 114/361
(58) Field of Search ..... 114/361

(56) References Cited

U.S. PATENT DOCUMENTS 5,044,298 A * 9/1991 Pepper et al. ..... 114/361
5,842,732 A * 12/1998 Daggett, et al. ..... 296/102
5,918,613 A 7/1999 Larson
5,931,114 A * 8/1999 Bartholomew ..... 114/361
6,327,993 B1 * 12/2001 Richens, Jr. ..... 114/361
6,349,666 B1 * 2/2002 Hastings ..... 114/361

OTHER PUBLICATIONS

Aquasport, 1993 Product Catalog, Sarasota, Florida.*

* cited by examiner

*Primary Examiner*—Stephen Avila
(74) *Attorney, Agent, or Firm*—Mandel & Peslak, LLC; Arthur M. Peslak, Esq.

(57) ABSTRACT

A structure for mounting a rigid T-Top on the surface of a boat deck is disclosed. The structure is easily customizable to almost any boat configuration. A method for mounting the structure is also disclosed.

3 Claims, 7 Drawing Sheets

SECTION A-A

CUSTOMIZABLE BOAT T-TOP AND METHOD OF INSTALLATION

BACKGROUND OF THE INVENTION

The present invention is directed to a T-Top that can be installed on the deck of a boat. Generally, a T-Top is installed over the operator station. T-Tops generally are used as add-ons to boats to provide shade over a portion of the boat deck. In addition to providing shade, the frame of the T-Tops can be used to install fishing rod holders, for example, or to hold other gear.

The present invention is more particularly directed to a T-Top that can be customized to fit any almost configuration of boat from standardized parts and can be installed easily by a boat owner even those who do not possess a high level of mechanical aptitude.

The presently available T-Tops such as are illustrated in U.S. Pat. No. 5,918,613 suffer from many disadvantages. First, the prior T-Tops all must be specially constructed to fit a particular boat. In general, the maker must cut and weld the frame for the T-Top to fit the precise dimensions for the particular boat on which the T-Top will be installed. Thus, installation is time consuming and generally cannot be performed by a boat owner who has limited mechanical aptitude. Second, given that the prior T-Tops are custom fit for each installation, the T-Top manufacturer does not have standardized parts that can be used for installation of a T-Top on virtually every size or style of boat. Third, given the disadvantages just described, the installation of existing T-Tops is expensive, labor intensive and time consuming.

SUMMARY OF THE INVENTION

The present invention solves the aforementioned difficulties in presently available T-Tops. This present invention provides a T-Top that can be easily installed by the owner of the boat. The T-Top of the present invention is constructed from standardized parts that can be easily adapted to fit virtually any configuration on the boat. However, the standardized parts of the present invention do not require the cutting and welding of the frame necessitated by the prior T-Tops.

DETAILED DESCRIPTION OF THE INVENTION

The presently preferred embodiment of the present invention will now be described in connection with the drawings.

However, this embodiment is merely illustrative of the present invention and is not meant to limit the spirit or scope of the appended claims.

Figure 1:
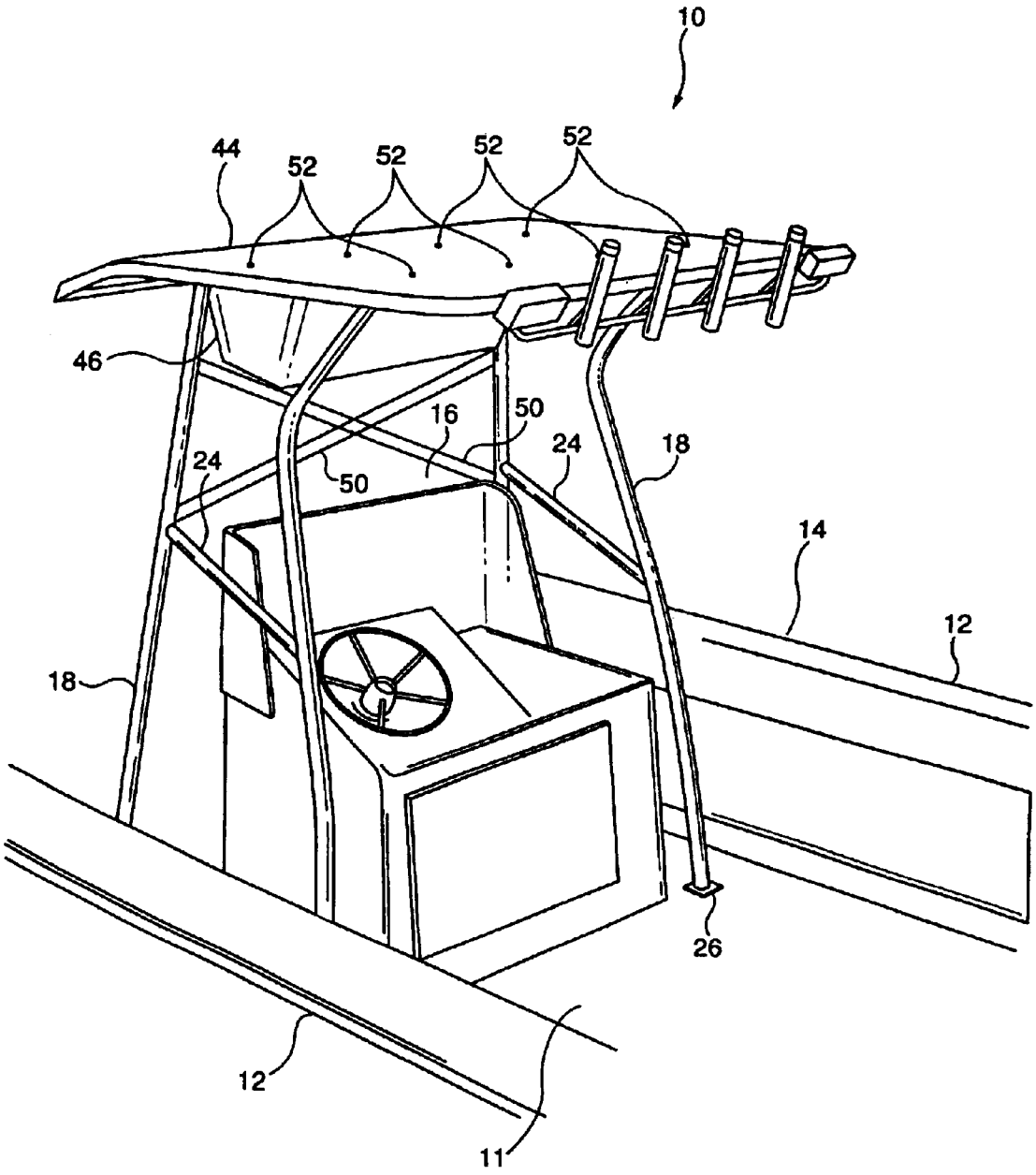
FIG. 1 is a plan view illustrating a T-Top of the present invention installed over the center console of a boat.

FIG. 1 illustrates a fully assembled T-Top 10 of the present invention. The T-Top assembly 10 is mounted to deck 11 between the sides 12 of the boat 14. In this installation, the T-Top assembly 10 is mounted over the center console 16. The construction and installation of the T-Top assembly 10 will now be described.

Figure 2C:
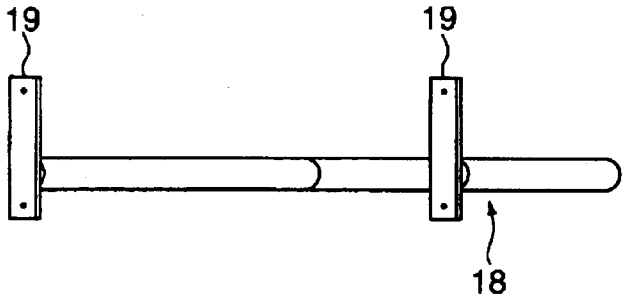
FIGS. 2A, 2B, & 2C illustrate side, front and top views respectively of a component of the T-Top of the present invention.
Figure 2A:
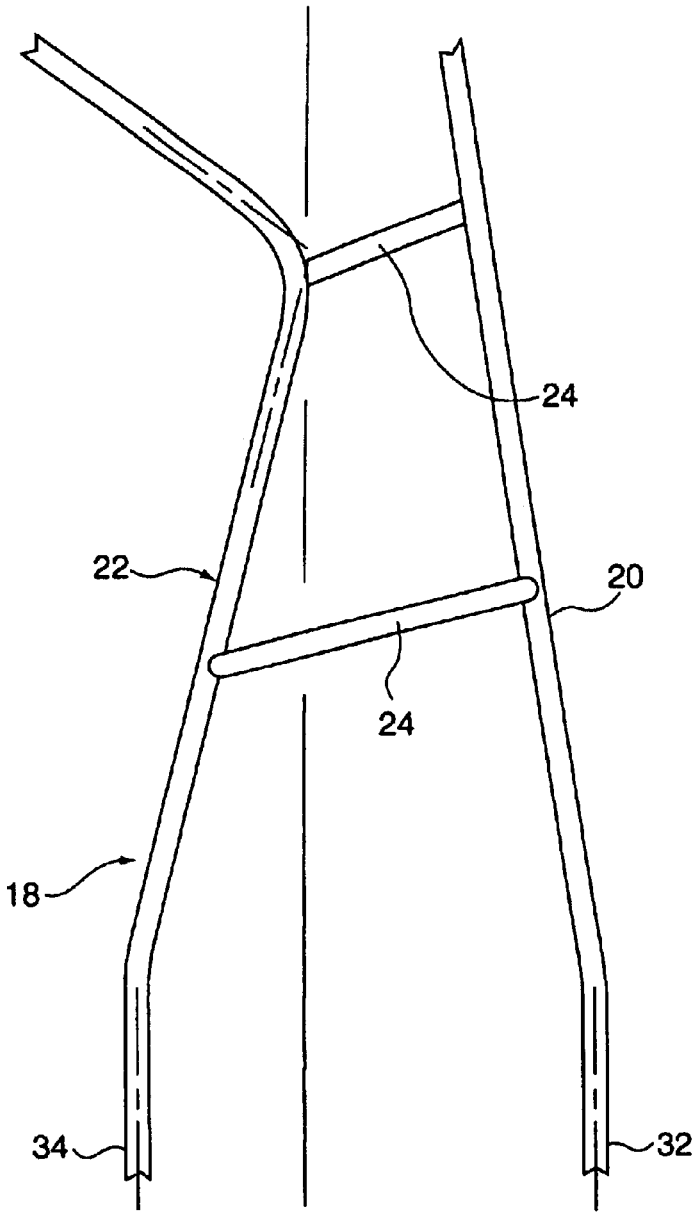
Figure 2B:
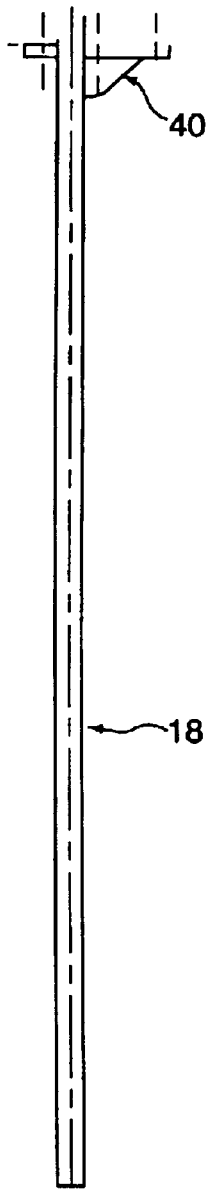

The T-Top assembly 10 comprises two vertical support frames 18. The vertical support frames 18 are illustrated in more detail in FIGS. 2A, 2B and 2C. The vertical support frames are fabricated from aluminum pipe. Each of the vertical support frames 18 comprise two generally vertical pipes 20 and 22. In addition, the vertical support frames 18 comprise a plurality of generally horizontal connecting pipes 24. The plurality of horizontal connecting support pipes 24 are welded to the generally vertical pipes 20 and 22 thus forming a solid structure.

Figure 3A:
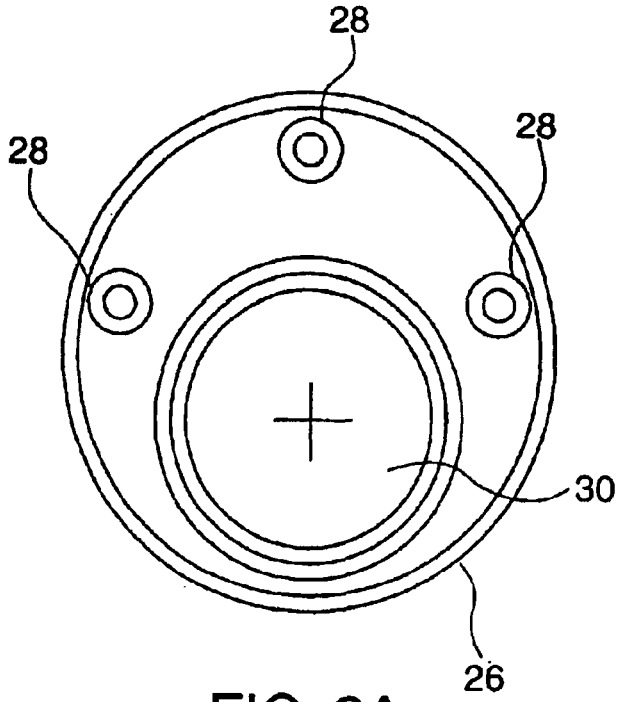
FIGS. 3A & 3B illustrate top and side views respectively of a component of the present invention.
Figure 3B:
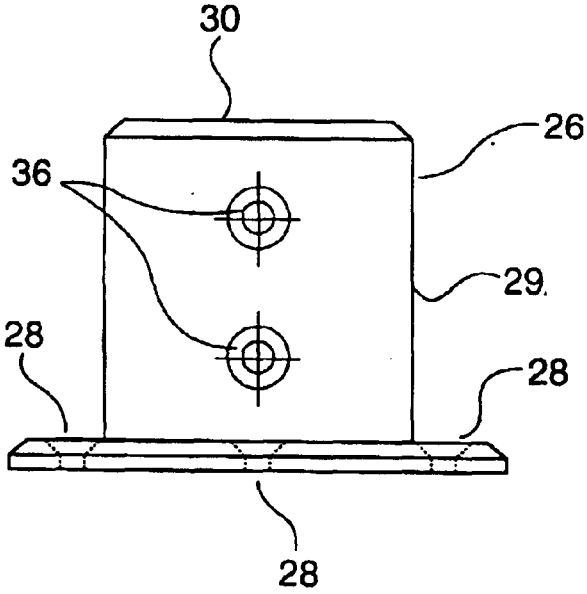

The vertical support frames 18 are mounted to the deck 11 of the boat 14 by means of a plurality of mounting brackets 26. The mounting brackets 26 are illustrated in more detail in FIGS. 3A and 3B. The mounting brackets 26 comprise a plurality of mounting holes 28. The mounting holes 28 are adapted to receive a plurality of fastening devices such as bolts. The mounting bracket 26 is thus fastened to the boat deck 11 by the aforementioned fastening devices as well as a sealant and/or adhesive. The mounting bracket 26 also comprises a cylindrical top portion containing an offset through hole 30. The through hole 30 is adapted to slidingly receive the bottom portions 32 and 34 of the vertical support pipes 20 and 22. The reason for the offset nature of the mounting through hole 30 is so that the vertical support pipes 20 and 22 can be mounted as close as possible to the center console 16 and thus make for easier passage of people around the T-Top 10 by consuming a minimum amount of space on the boat deck 11. The mounting bracket 26 also comprises horizontal through holes 36.

Figure 6B:
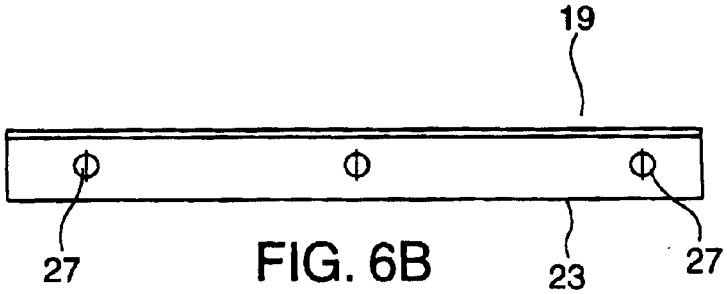
FIGS. 6A, 6B & 6C illustrate front, top and side views respectively of a component of the present invention.
Figure 6A:
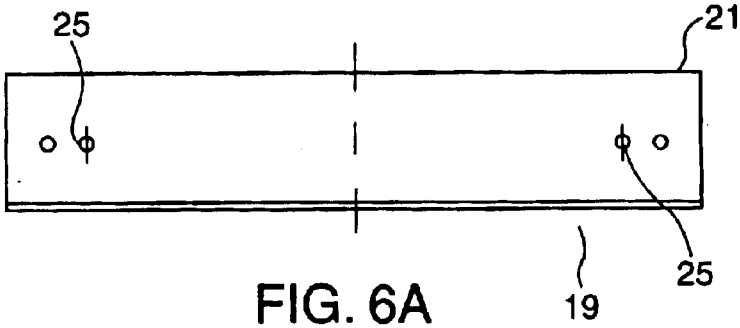
Figure 6C:
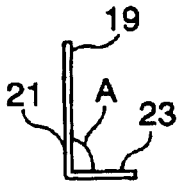

An angle bracket 19 is rigidly mounted to the top of each of the vertical support pipes 20 and 22. In this embodiment, it is presently contemplated that the angle bracket 19 will be mounted to the vertical support pipes 20 and 22 by welding. The angle bracket 19 is illustrated in detail in FIGS. 6A, 6B and 6C. As can be seen from FIGS. 6A and 6B, the angle bracket 19 comprises a first longitudinal surface 21 and a second longitudinal surface 23. The first and second longitudinal surfaces 21 and 23 are joined at an approximately perpendicular angle A. The first longitudinal surface 21 comprises a first plurality of through holes 25 and the second longitudinal surface 23 comprises a second plurality of through holes 27.

Figure 5A:
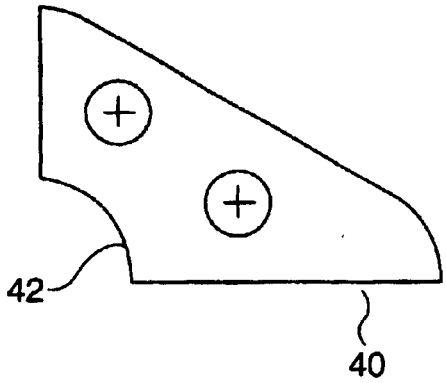
FIGS. 5A & 5B illustrate front and side views respectively of a component of the present invention.
Figure 5B:
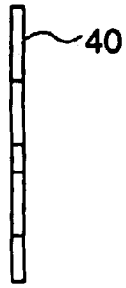

A gusset 40 is rigidly mounted between each of the angle brackets 19 and the vertical support pipes 20 and 22. The gusset 40 is illustrated in FIGS. 5A and 5B. The gusset 40 is contemplated to be mounted by welding to the angle brackets 19 and the respective vertical support pipe 20 or 22.

Figure 4A:
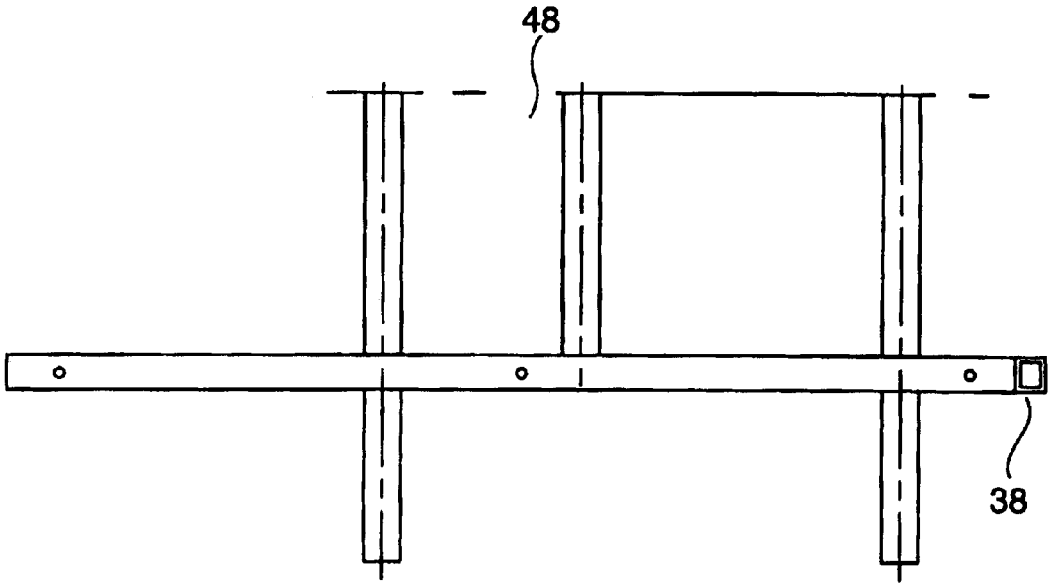
FIGS. 4A & 4B illustrate bottom and side views respectively of a component of the T-Top of the present invention.
Figure 4B:
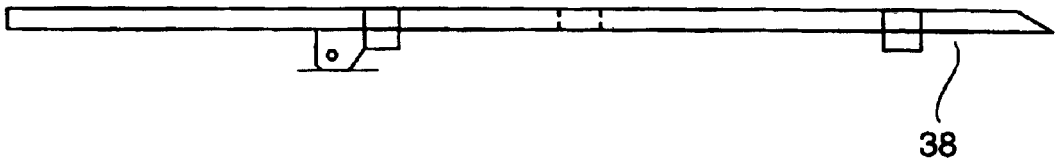

The T-Top assembly 10 further comprises a reinforcing grid 38 as illustrated in FIGS. 4A and 4B. The reinforcing grid 38 will be connected to the top of the vertical pipes 20 and 22 by means of the angle brackets 19 as described below.

Figure 7A:
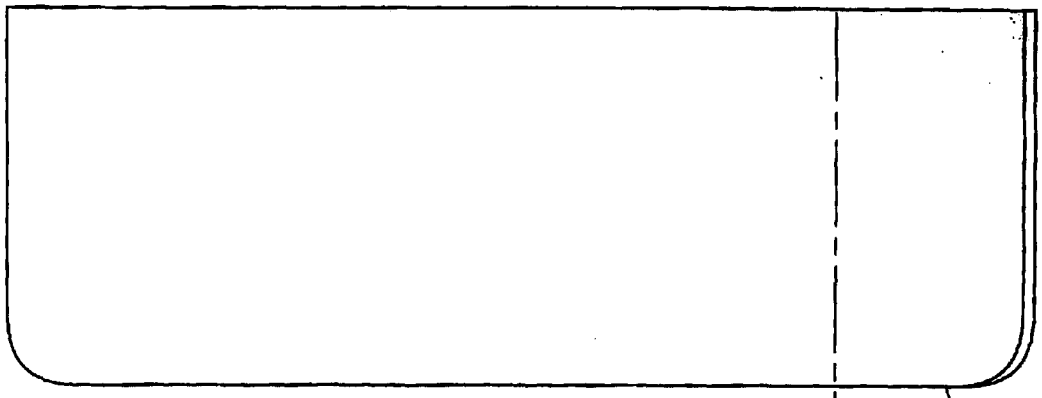
FIGS. 7A, 7B & 7C illustrate top, side and sectional views respectively of a component of the present invention.
Figure 7B:
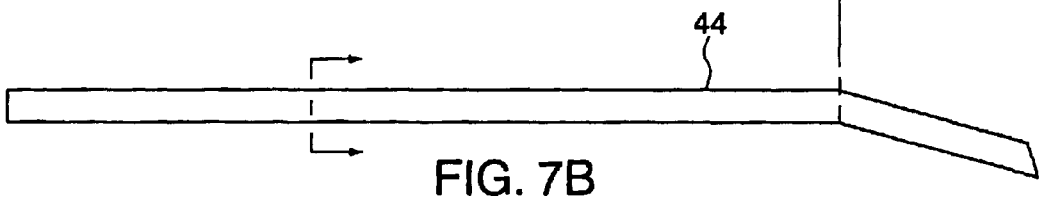
Figure 7C:
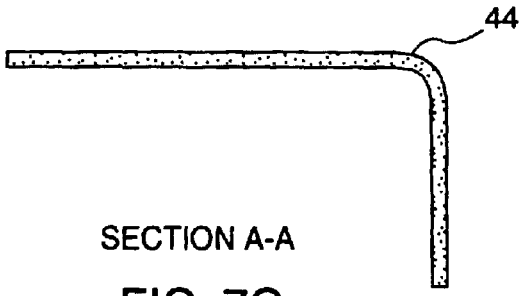

The T-Top assembly 10 further comprises the T-Top lid 44. The T-Top lid 44 is illustrated in detail in FIGS. 7A, 7B & 7C. The T-Top lid 44 is presently contemplated to be fabricated from molded fiberglass.

Figure 8:
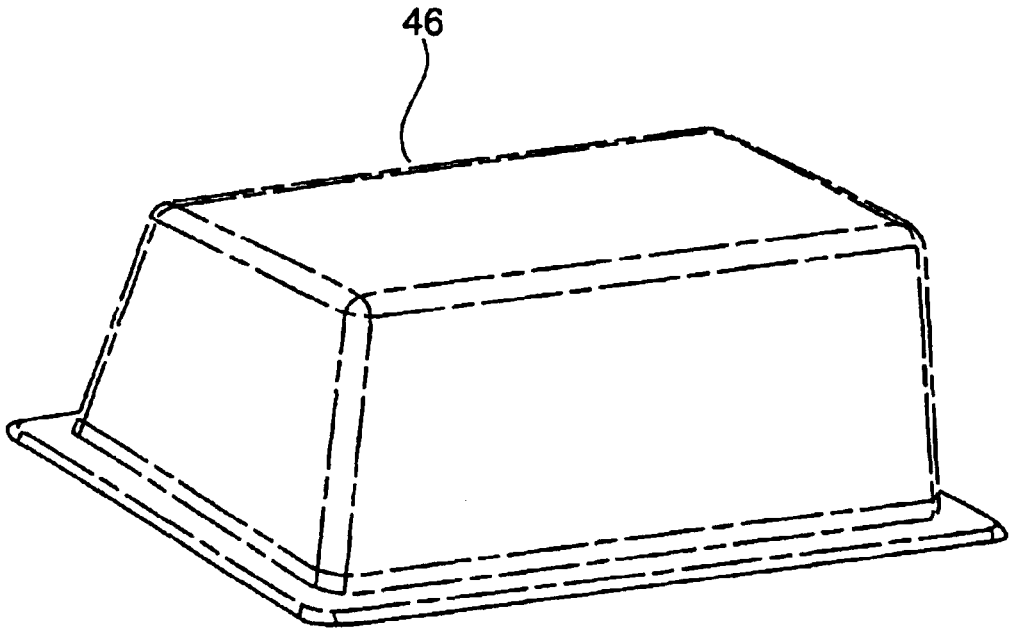
FIG. 8 is a front plan view of a component of the present invention.

The reinforcing grid 38 further comprises an opening 48. The opening 48 is adapted to receive a storage compartment 46. The storage compartment 46 is illustrated in detail in FIG. 8. The storage compartment 46 is generally contemplated for use as an enclosure for electronic equipment that may be used on the boat. The present invention is particularly adapted to utilize storage compartment 46 to enclose electronic equipment since the reinforcing grid 48 and the vertical support pipes 20 and 22 are all of annular construction allowing for the easy routing of electrical cable from the storage compartment 46, through the annuli in the frame parts and into the control console 16 on the boat.

The first step in the assembly of the T-Top 10 to the boat 14 is to determine the placement of the vertical support frames 18 on the respective sides of the boat console 16. At this point, the installer determines the placement of the four mounting brackets 26 by centering the T-Top 10 over the center of the console 16. In addition, the installer also determines the height of the installation of the T-Top 10 relative to the boat deck 11. If the installer desires to mount the T-Top 10 at a lower height relative to the boat deck 11, that can be accomplished by removing part of the vertical support pipes 20 and 22 to result in a lower height from the boat deck 11 to the top of the T-Top 10. The removal can be accomplished with a standard saw adapted for sawing metal pipe.

After the vertical support pipes 20 and 22 are adjusted for the proper height, the pipes 20 and 22 are then rigidly connected to the reinforcing grid 38. The first plurality of through holes 25 on angle bracket 19 may be used for temporary connection of the support pipes 20 and 22 to the reinforcing grid 38 by means of sheet metal screws or other temporary mounting means while the permanent mounting holes are drilled. The second plurality of through holes 27 on angle bracket 19 are used for permanent mounting of the vertical support pipes 20 and 22 to the reinforcing grid 38. The permanent mounting is accomplished by aligning the vertical support pipes 20 and 22 to the proper position on the reinforcing grid 38 so that the T-Top 10 will be symmetrically mounted over the center of the boat console 16. A plurality of through holes are then drilled through the second plurality of holes 27 through both sides of the reinforcing grid 38 at the selected mounting points. Bolts are then placed through the angle bracket 19 and through the reinforcing grid 38 and connected with appropriate washers and nuts. In this manner, a rigid structure is created.

At this point, the storage compartment 46 is placed into opening 48 in reinforcing grid 38. The storage compartment is generally sealed in place with adhesive in the reinforcing grid 38. This structure, comprising the vertical support pipes 20 and 22, the reinforcing grid 38 and the storage compartment 46 is then taken to the boat 14 for mounting.

The four mounting brackets 26 are first mounted to the bottom of the vertical pipes 20 and 22. The bottom of the vertical pipes 20 and 22 are slidingly placed into the respective through hole 30 in the mounting bracket 26. Two mounting holes will be drilled into the vertical mounting pipes 20 and 22 through holes 36 in the upper portion 29 of mounting bracket 29. Fastening devices such as sheet metal screws will be placed through these holes to rigidly mount the vertical pipes to each of the mounting brackets 26. An appropriate sealant may be placed at the top edge of upper portion 29 after the joining process to prevent water from seeping down between the vertical support pipes 20 and 22 and the inside of through hole 30.

The structure is then placed at the mounting points on the surface of the boat deck 11. The structure is then connected to the boat deck 11 by means of the plurality of mounting holes 28 on the mounting bracket 26. The installer will place adhesive and sealant on the bottom surface of the mounting bracket 26 which will be in contact with the top surface of the boat deck 11. Holes will be drilled through mounting holes 28 into the boat deck 11. Fastening devices such as bolts or self-tapping screws can be used to join the structure to the boat deck through the mounting holes 28.

If desired, reinforcing rods 50 can be joined between the front vertical support pipes 20 as shown in FIG. 1. These reinforcing rods 50 provide extra rigidity to the structure of the T-Top assembly 10.

At this point, the T-Top lid 44 is placed on top of the reinforcing grid 38. The T-Top lid 44 is joined to the reinforcing grid 38 by appropriate fastening devices such as bolts at the plurality of points 52 shown in FIG. 1.

Those of ordinary skill in the art will recognize that the embodiments just described merely illustrate the principles of the present invention. Many modifications may be made thereto without departing from the spirit and scope of the invention as set forth in the following claims.

What is claimed is:

1. A customizable boat covering structure kit for fitting to a plurality of different sized boats comprising:

a) a customizable frame for mounting to a deck of the boat wherein the customizable frame comprises two vertical support frames that are trimmed from a standard size to a predetermined height from the deck of the boat and further comprising a top end and a bottom end and a reinforcing grid adapted for rigid mounting to the top end of the vertical support frames;

b) a lid adapted to be rigidly mounted to the reinforcing grid; and c) means for rigidly connecting the bottom of the vertical support frames to the deck of the boat.

2. The boat covering structure of claim 1 wherein the vertical support frames comprise a plurality of generally vertical pipes and a plurality of horizontal connecting pipes wherein the plurality of horizontal connecting pipes are sized for a width corresponding to the desired mounting width and are adapted to be rigidly connected to the plurality of generally vertical pipes.

3. A method for installing a customizable boat covering structure kit on a deck of a variety of different sized boats comprising the steps of:

a) determining a plurality of mounting points on the deck of the boat for the structure;

b) providing a plurality of customizable standard size vertical support frames of a predetermined length with a plurality of bottom ends corresponding to the plurality of mounting points;

c) determining the height of the boat covering structure relative to the boat deck;

d) adjusting the height of the vertical support frames by permanently removing part of the vertical support frames so that the final length is less that the predetermined length to correspond to the determined height;

e) providing a reinforcing grid adapted to be rigidly connected to the top end of the plurality of vertical support frames;

f) providing a plurality of customizable horizontal supports adapted to fit the width of the boat and to be rigidly connected to the vertical support frames;

g) rigidly connecting a lid to the reinforcing grid to form a solid structure; and h) rigidly mounting the solid structure at the plurality of mounting points on the deck of the boat.

* * * * *